United States Patent [19]

Calcerano

[11] Patent Number: 4,958,731

[45] Date of Patent: Sep. 25, 1990

[54] BATTERY PACKAGE

[75] Inventor: Victor A. Calcerano, Carmel, N.Y.

[73] Assignee: Duracell Inc., Bethel, Conn.

[21] Appl. No.: 440,144

[22] Filed: Nov. 22, 1989

[51] Int. Cl.[5] ..... B65D 73/00

[52] U.S. Cl. ..... 206/333; 206/471

[58] Field of Search ..... 206/333, 461–471

[56] References Cited

U.S. PATENT DOCUMENTS 2,985,296 5/1961 Kahn ..... 206/470

3,966,045 6/1976 Perdue ..... 206/461

FOREIGN PATENT DOCUMENTS 2557540 6/1977 Fed. Rep. of Germany ..... 206/461

2029360 3/1980 United Kingdom ..... 206/461

*Primary Examiner*—William I. Price

*Attorney, Agent, or Firm*—Ronald S. Cornell; James B. McVeigh, Jr.

[57] ABSTRACT

This invention relates to a blister card package for more than four cylindrical batteries wherein a majority of the batteries are visible from the front.

14 Claims, 1 Drawing Sheet

BATTERY PACKAGE

The present invention relates to a package for the sale and display of cylindrical batteries, particularly slim diameter batteries such as the AA size or smaller. The package comprises a blister formed to closely hold a plurality of batteries in at least two rows, one behind the other, with the front row having fewer batteries than the next adjacent rows. Such an arrangement allows a purchaser to view a majority of the batteries in the second row through the front of the blister.

A majority of small sized batteries are sold in blister card packages hung from display rods located near the point of purchase. Generally, the retailer allocates a finite amount of space for the display of batteries and he prefers that all the packages are about the same size so that the display rods do not need to be specially arranged to accommodate different sized packages. Therefore, battery manufacturers must provide display packages of similar size regardless of the size or number of batteries in the package. For example, most battery blister cards have a card dimension of about 3.8 inches wide and 4.5 inches high.

For small diameter batteries such as "AA" size alkaline cells it has been the practice to package four cells in side-by-side arrangement, which arrangement takes up about two inches. Because of the high consumer demand for this cell size, manufacturers have provided eight-cell packages wherein two rows of four cells each are packaged in a single blister. Two superimposed rows are used because the conventional package is not wide enough to arrange eight cells side-by-side. A disadvantage of this arrangement is that a consumer could be misled into thinking that only four cells are contained in the package which in turn creates an impression of a high price per cell. Such misperception could cause the purchaser not to buy the batteries.

It is therefore an object of the present invention to provide a package for the sale and display of more than four cylindrical batteries arranged in at least two rows whereby a majority of the batteries in the second row are viewable from the front.

It is another object of the present invention to provide a blister for a battery package which can easily be filled by high speed equipment.

The features and advantages of the present invention will be explained in detail below with reference to the drawings in which;

FIG. I is a perspective view of a blister card package made in accordance with the present invention;

Generally, the present invention is a package for the sale and display of a plurality of cylindrical batteries in at least two rows, one behind the other, wherein the first row has fewer batteries than the next row. The package comprises a transparent plastic blister having a top, a bottom, and a contoured portion between said top and bottom. The blister has an open back for loading batteries into the blister. The contoured portion of the blister is shaped to receive a first row of batteries in which none of the batteries touch each other. Means are provided to prevent nesting of batteries between the batteries in the first row while they are loaded into the next row.

Preferably, the blister is formed to hold two rows of batteries. In a most preferred embodiment, each row has an odd number of batteries, and the front row has two fewer batteries than the back row. The contoured portion has a front which is shaped to receive the first row and has sides spaced apart for holding the back row of batteries in side-by-side configuration. The contoured portion is formed to hold the middle battery in the front row directly in front of the middle battery of the second row, and each remaining battery in the front row is held between adjacent batteries in the back row. In this arrangement, all of the batteries in the second row, except for the middle battery, are viewable through the front of the blister.

It is preferred that both the top and bottom portions of the blister each have indentations formed therein directly coinciding with the center of each battery in the second row. Said indentations prevent excessive axial movement of the batteries during shipping and handling.

Figure 1:
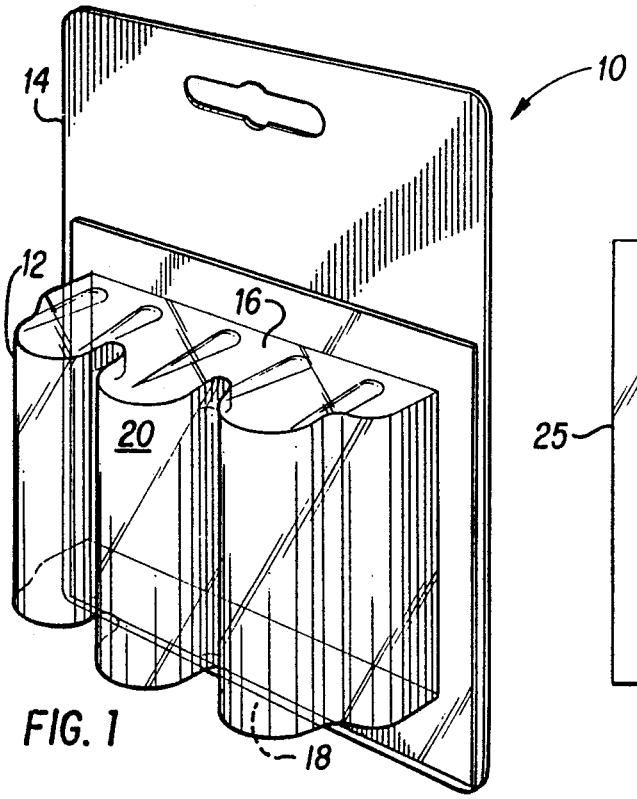

Referring now to the drawings, FIG. 1 shows a perspective view of a package 10 for containing eight AA cells made in accordance with the present invention. Package 10 comprises a blister 12 and a backing member 14. Blister 12 has a top 16, a bottom 18, and contoured portion 20 between said top and bottom. Contoured portion 20 has a height approximately equal to the height of a AA size battery whereby top 16 and bottom 18 are adapted to hold batteries therebetween.

Figure 2:
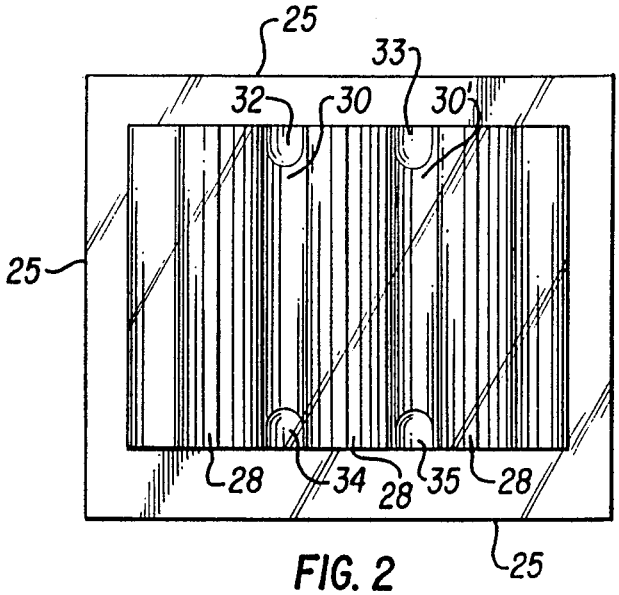
FIG. 2 is a front plan of a blister from a package made in accordance with the present invention.
Figure 3:
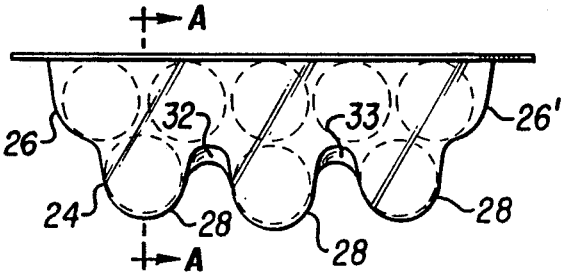
FIG. 3 is a top plan view of the blister shown in FIG. 2 (the bottom plan view being a mirror image thereof)

Contoured portion 20 comprises a front 24 and sides 26, 26'. In the embodiment shown (FIGS. 2 and 3), front 24 has three receptacles 28 formed therein, each being adapted to hold one battery. Adjacent receptacles are separated by dividers 30, 30'. Thus, when the front row of blister 12 is loaded with three batteries, each readily falls into one of receptacles 28. A second row of five batteries is then loaded on top of the first row with the batteries in the second row being held in place by appropriately spaced side portions 26, 26'.

In a preferred embodiment, means 32, 33, 34, and 35 are provided at the upper and lower end of dividers 30, 30' to prevent nesting. Means to prevent nesting are desirable because the batteries being loaded in the second row tend to become lodged in the large gaps between adjacent batteries in the first row. In a presently preferred embodiment, the means to prevent nesting comprises inwardly directed, rounded depressions 32, 33, 34, 35 formed in contoured portion 20 between adjacent receptacles 28. The depressions project inwardly a sufficient distance so that a battery being loaded in the second row seats on both a depression and an adjacent front row cell. In a preferred embodiment the dividers 30, 30' each comprise inwardly directed depressions formed at each end.

Rather than being located at opposite ends of dividers 30, 30' the denesting means could traverse the entire length of the dividers, whereby the dividers would become the denesting means. However, this would impart an undesirable depth to the dividers themselves and to receptacles 28.

Figure 4:
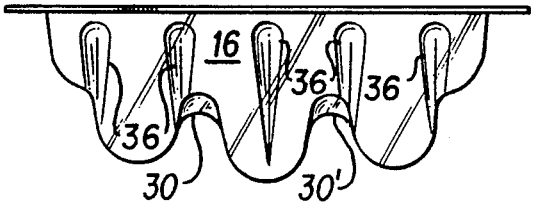
FIG. 4 is a top plan view of an alternate blister embodiment.
Figure 5:
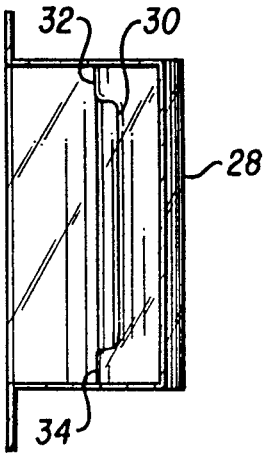
FIG. 5 is a cross-sectional view through the blister of FIG. 3 along the line A—A.

In a preferred embodiment, top 16 and bottom 18 are also provided with inwardly directed teardrop shaped protrusions 36, as shown in FIG. 4, with a protrusion positioned over the center of each battery in the back row. It is common when thermoforming plastic components to taper the mold so that the tool is easily extracted from the formed part. Thus, top 16 and bottom 18 taper away from each other towards the rear of blister 12. Without teardrop depressions 36, the batteries in the back row would not be held as closely as the batteries in the front row. However, protrusions 36 hold the back row of batteries more closely to minimize axial motion.

Blister 12 preferably includes a flange 25 for attaching filled blister !2 to card 14

Alternatively, blister 12 may be hinged to a rear card or blister. In the case where the rear member is a blister, the front blister need not be as deep as the blister shown in the drawings, and only half (more or less) of the diameter of the second row of cells would be held in each blister. The rear blister would be folded upwardly to mate with the front blister. The front and rear blisters could be held together at their peripheries which would each be provided with flanges.

The front blister is preferably made from a clear, strong thermoformable plastic. While the preferred plastic for constructing the package is cold-crack resistant polyvinyl chloride, other plastics are suitable. These include non-cold-crack polyvinyl chloride, cellulose propionate, polyethylene terephthalate glycol modified (PETG), and polystyrene. While the package described was made from a sheet stock about 0.014 inch thick, the thickness may range from 0.008 inch to 0.016 inch.

It is to be understood that deviations can be made from the specific description given above and still remain within the spirit and scope of the present invention as claimed.

What is claimed is:

1. A package for the sale and display of a plurality of cylindrical objects in at least two rows, one behind the other; wherein the first, front row has fewer objects than the next row; said package comprising a blister having a top, a bottom, and a contoured portion between said top and said bottom; and wherein said blister has an open back for loading said cylindrical objects into the blister; said contoured portion of the blister being shaped to receive a first row of objects in which none of the objects touch each other, and said contoured portion including means to prevent nesting between the objects in the first row objects being loaded into said next row.

2. The package of claim 1 wherein said contoured portion comprises cylindrically shaped receptacles for holding the front row of cylindrical objects and said objects are batteries.

3. The package of claim 1 wherein said contoured portion further includes dividers whereby said dividers prevent adjacent objects in the first row from touching.

4. The package of claim 2 wherein said means to prevent nesting comprises inwardly directed, rounded depressions formed in said blister between adjacent receptacles with said depressions projecting inwardly a sufficient distance so that a battery being loaded in the second row seats on both a depression and an adjacent front row cell.

5. The package of claim 3 wherein said means to prevent nesting comprises inwardly directed depressions formed at opposite ends of each divider.

6. The package of claim 1 wherein said top and said bottom are each provided with inwardly directed indentations centered over the situs of each cylindrical object in the said next row whereby said indentations limit axial movement of those objects.

7. The package of claim 1 wherein said blister is formed from a material selected from the group consisting of cold-crack resistant polyvinyl chloride, non-cold crack polyvinyl chloride, cellulose propionate, polyethylene terephthalate glycol modified (PETG), and polystyrene.

8. The package of claim 1 wherein the blister is formed to hold eight AA size batteries with the front row having three batteries and the next row having five batteries arranged in side-by-side configuration, wherein the middle battery in the front row is directly in front of the middle battery in the next row and the two batteries on the ends of the first row are each located in the concavity formed by the two outermost batteries at each end of the second row.

9. A package for the sale and display of batteries comprising a blister having a front portion and side portions formed to hold two rows of batteries; wherein said front portion is formed to hold the middle battery in the front row directly in front of the middle battery in the second row and said front portion is also formed to hold the remaining batteries in the front row offset from the adjacent batteries in the second row, whereby all of the batteries are visible through the front of the package.

10. The package of claim 9 wherein each row has an odd number of batteries and the front row has two less batteries than the second row; wherein said side portions are appropriately spaced apart for holding the batteries in the the second row in side-by-side configuration.

11. The package of claim 9 wherein said front portion is comprised of a plurality of receptacles for holding the front row of batteries.

12. The package of claim 9 wherein said front portion comprises means for preventing batteries being loaded into the second row from nesting between the batteries in the first row.

13. The package of claim 9 wherein said blister comprises a top, a bottom, and a contoured portion connected therebetween; said top and said bottom each having indentations formed therein with an indentation being centered over each battery in the second row so that axial movement of the said batteries is minimized.

14. The package of claim 9 wherein said blister is formed to hold eight AA size batteries.

* * * * *